US006293254B1

(12) United States Patent
Crofts et al.

(10) Patent No.: US 6,293,254 B1
(45) Date of Patent: Sep. 25, 2001

(54) FUEL INJECTOR WITH FLOATING SLEEVE CONTROL CHAMBER

(75) Inventors: John D. Crofts, Edinburgh; C. Edward Morris; Donald J. Benson, both of Columbus, all of IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/479,247

(22) Filed: Jan. 7, 2000

(51) Int. Cl.[7] ..... F02M 41/00
(52) U.S. Cl. ..... 123/467; 123/447
(58) Field of Search ..... 123/467, 500, 123/501, 446, 447, 496

(56) References Cited

U.S. PATENT DOCUMENTS

| | | | | |
|---|---|---|---|---|
| 4,605,166 | | 8/1986 | Kelly . | |
| 4,784,102 | | 11/1988 | Igashira et al. . | |
| 4,798,186 | * | 1/1989 | Ganser | 123/467 |
| 4,957,085 | | 9/1990 | Sverdin . | |
| 5,067,658 | | 11/1991 | De Matthaeis et al. . | |
| 5,156,132 | * | 10/1992 | Iwanaga | 123/496 |
| 5,537,972 | * | 7/1996 | Beck et al. | 123/198 DB |
| 5,660,368 | | 8/1997 | De Matthaeis et al. . | |
| 5,694,903 | * | 12/1997 | Ganser | 123/496 |
| 5,819,704 | | 10/1998 | Tarr et al. . | |
| 5,860,597 | | 1/1999 | Tarr . | |
| 5,890,471 | * | 4/1999 | Nishimura | 123/496 |
| 6,021,760 | * | 2/2000 | Boecking | 123/467 |

FOREIGN PATENT DOCUMENTS

| | | | | |
|---|---|---|---|---|
| 0188069 | * | 10/1984 | (JP) | 123/467 |

* cited by examiner

*Primary Examiner*—Carl S. Miller
(74) *Attorney, Agent, or Firm*—Nixon Peabody LLP; Charles M. Leedon, Jr.; Tim L. Brackett

(57) ABSTRACT

A fuel injector including a floating sleeve control chamber is provided which effectively minimizes friction and wear, and thus prevents stiction, of a nozzle valve element by avoiding the need to align two bore guiding surfaces for the element. The floating sleeve control chamber includes a floating sleeve positioned on a control piston formed integrally with a nozzle valve element and positioned in a cavity. The floating sleeve is sized with an outer extent or diameter sufficiently less than the size of a surrounding cavity wall so as to permit lateral movement of the floating sleeve and thus movement of the control chamber. Only the nozzle valve element guiding bore surfaces control the alignment of the nozzle valve element relative to its seat while the floating sleeve effectively forms and seals a floating control chamber. The floating sleeve may be formed from one or more sleeve sections. In addition, the floating sleeve may include one or more swivel joints to accommodate perpendicularity errors between the components.

21 Claims, 4 Drawing Sheets

FUEL INJECTOR WITH FLOATING SLEEVE CONTROL CHAMBER

TECHNICAL FIELD

The invention relates to a fuel injector having a servo-controlled nozzle valve which effectively controls fuel metering while minimizing fuel leakage from the injector.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle ofifices, thus marking the beginning of injection.

In another type of system, such as disclosed in U.S. Pat. No. 5,819,704, the beginning of injection is controlled by a servo-controlled nozzle valve element. The assembly includes a control volume positioned adjacent to the outer end of the nozzle valve element, a drain circuit for draining fuel from the control volume to a low pressure drain, and an injection control valve positioned along the drain circuit for controlling the flow of fuel through the drain circuit so as to cause the movement of the nozzle valve element between open and closed positions. Opening of the injection control valve causes a reduction in the fuel pressure in the control volume resulting in a pressure differential which forces the nozzle valve open, and closing of the injection control valve causes an increase in the control volume pressure and closing of the nozzle valve. U.S. Pat. No. 5,860,597 to Tarr discloses a similar servo-controlled nozzle assembly for a fuel injector which controls drain flow through the drain circuit by positioning of the control valve element relative to the valve.

The above-described servo-controlled nozzle valve injectors also function effectively at minimizing lost energy by eliminating nozzle valve guide and control piston leakage paths to drain. This advantage is achieved by using a pressurized spring cavity typically fluidically connected to the nozzle valve cavity. As a result of using a pressurized spring cavity, the nozzle valve element and the control piston must be connected or formed integrally to permit operation. Consequently, there is a need for precise alignment between the nozzle valve element guide surfaces/seat and the control piston bore. FIG. 1 illustrates a conventional servo-controlled injector 10 including an injection control valve 12 for controlling the timing and metering of injection by controlling the drain flow of fuel from a control chamber 14. The injector 10 further includes a nozzle valve element 16 and a control piston 18 formed integrally. A precision ring dowel 20 is used to align the nozzle housing 22 forming the nozzle valve element guide surfaces 24 and seat 26, with the control piston bore 28 formed by the injector body 30. However, even with costly precision machining, this design does not sufficiently align the various guide surfaces of the nozzle housing and the control piston bore. This misalignment undesirably causes the nozzle valve element to experience excessive friction, wear and possibly even stiction. In addition, disadvantageously, a non-symmetrical spray pattern may result in valve covered orifice type nozzle valves thereby adversely affecting combustion.

U.S. Pat. No. 4,798,186 discloses a nozzle controlled fuel injector including a control volume formed by a piece positioned on the outer end of the nozzle valve element. The piece is not guided at its outer circumference to provide a substantially leak free, seal-tight design, and an unhindered axial motion of the injector nozzle valve thereby reducing undesired frictional forces which would occur in case all tight fits needed for a tight seal were not perfectly concentrical to one another. The piece completely encircles the outer end of the nozzle valve element. The piece is biased into engagement against a flat lower surface of a support only by fuel pressure in the control volume. When the control valve opens and drains fuel from the control volume thereby decreasing control volume pressure, the bias force holding the piece against the flat surface of the support decreases substantially. When the control valve is closed, the fuel pressure induced biasing forces against the piece are substantial thereby preventing lateral movement of the piece. Also, two annular leakage passages (63, 69) separate the high pressure regions in the spring cavity and the control chamber. At high pressures, this leakage to drain can be significant.

U.S. Pat. No. 5,067,658 discloses a nozzle controlled injector including a control chamber positioned at the outer end of a nozzle plunger and a top sleeve for slidably receiving the outer end of the plunger. The outer end of the sleeve functions to seal the control chamber. In addition, an elastic element is used to fixedly position the top sleeve by providing a slack free assembly. However, the top sleeve is positioned in an axial bore with a sufficiently close tolerance fit to require an axial groove in the sleeve to permit passage of fuel flow through the close tolerance fit. Therefore, this design does not provide sufficient lateral movement of the top sleeve to accommodate for misalignments.

U.S. Pat. No. 4,605,166 is noted for disclosing an injector including a nozzle valve element and a sleeve mounted on an outer end of the nozzle valve element wherein the sleeve sealingly engages a support while being biased into engagement by a bias spring which also biases the nozzle valve element into a closed position. However, the collar or sleeve functions as a check valve and is therefore axially movable.

Therefore, there is a need for a simple, inexpensive nozzle controlled injector assembly capable of effectively permitting precise alignment of nozzle valve guiding surfaces and a control piston bore while permitting effective control of fuel metering.

SUMMARY OF THE INVENTION

It is, therefore, one object of the present invention to overcome the deficiencies of the prior art and to provide a fuel injector which minimizes lost energy by minimizing fuel leakage from the injector to drain.

Another object of the present invention is to provide a simple, reliable fuel injector including a pressurized nozzle spring cavity.

Yet another object of the present invention is to provide a fuel injector which provides for simple alignment of a control piston bore and a nozzle valve guide bore.

Still another object of the present invention is to provide a fuel injector which effectively prevents the nozzle valve element from experiencing excessive friction, wear, bending and stiction due to misalignment of nozzle valve element and control piston guide surfaces.

It is yet another object of the present invention to provide a fuel injector having a servo-controlled nozzle assembly which effectively and reliably produces a predetermined, desired spray pattern.

Yet another object of the present invention is to provide a fuel injector having a servo-controlled nozzle assembly which effectively aligns nozzle valve element guide surfaces and a control piston bore in a less expensive manner relative to existing assemblies.

A still further object of the present invention is to provide a fuel injector which is capable of accommodating significant perpendicularity error between a nozzle valve element and a support for abutment by a sleeve forming a control piston bore.

Yet another object of the present invention is to provide a fuel injector without annular leakage passages from the high pressure regions to the low pressure drain region to minimize energy losses from pressurized fuel leakages.

These and other objects are achieved by providing a closed nozzle injector for injecting fuel at high pressure into the combustion chamber of an engine, comprising an injector body containing an injector cavity and an injector orifice communicating with one end of the injector cavity to discharge fuel into the combustion chamber. The injector also includes a nozzle valve element positioned in one end of the injector cavity adjacent the injector orifice. The nozzle valve element is movable between an open position in which fuel may flow through the injector orifice into the combustion chamber and a closed position in which fuel flow through the injector orifice is blocked. A control piston is positioned on the nozzle valve element and a floating sleeve is mounted on the control piston for lateral movement relative to the injector body. The floating sleeve at least partially defines a control chamber. This sleeve includes a bore for receiving the control piston, an open distal end and an open distal end sealing surface positioned in continuous sealing abutment against the injector body to prevent fuel flow from the control chamber. A drain circuit for draining fuel from the control chamber to a lower pressure drain is also provided. In addition, an injection control valve positioned along the drain circuit is provided to control fuel flow from the control volume. A charge circuit for supplying pressurized fuel to the control chamber may also be provided wherein the charge circuit includes a charge passage formed in the floating sleeve or any other nearby component which can connect the supply pressure cavity with the control chamber. The floating sleeve includes an outer surface positioned a spaced radial distance from the injector body to permit the lateral movement of the floating sleeve relative to the injector body. The injection control valve may be movable between an open position causing depressurization of the control chamber and a closed position causing pressurization of the control chamber. The injector may further include a biasing means for biasing the open distal end sealing surface into sealing abutment against the injector body with a first biasing force when the injection control valve is in the closed position and a second biasing force when the injection control valve is in an open position. The second biasing force is greater than the first biasing force. The biasing device may include a spring for applying the first biasing force and fuel pressure forces for applying the second biasing force to the floating sleeve.

In another embodiment, the floating sleeve may include a sleeve seat section and a main sleeve section positioned in sealing abutment against the sleeve seat section to form an upper swivel joint. The floating sleeve may further include a spring seat sleeve section positioned in abutment against the main sleeve section to form a lower swivel joint. The main sleeve section is then positioned axially between the sleeve seat section and the spring seat sleeve section.

In yet another embodiment, the floating sleeve may include a sleeve seat section that has the upper end closed and includes both the drain passage orifice and the charge passage and forms a portion of the control chamber. A main sleeve section is positioned in sealing abutment against the first to form the upper swivel joint as well as a portion of the control chamber.

In yet another embodiment, the floating sleeve may include a first sleeve and a second sleeve positioned in sealing abutment against the first sleeve. Each of the first and second sleeves may include a bore with which the control piston has a sufficiently close sliding fit to form a fluid seal. Also, the charge passage may be formed in the sleeve seat section. Preferably, the control piston is formed integrally with the nozzle valve element.

DETAILED DESCRIPTION OF THE INVENTION

Throughout this application, the words "inward", "innermost", "outward" and "outermost" will correspond to the directions, respectively, toward and away from the point at which fuel from an injector is actually injected into the combustion chamber of an engine. The words "upper" and "lower" will refer to the portions of the injector assembly which are, respectively, farthest away and closest to the engine cylinder when the injector is operably mounted on the engine.

Figure 2A:
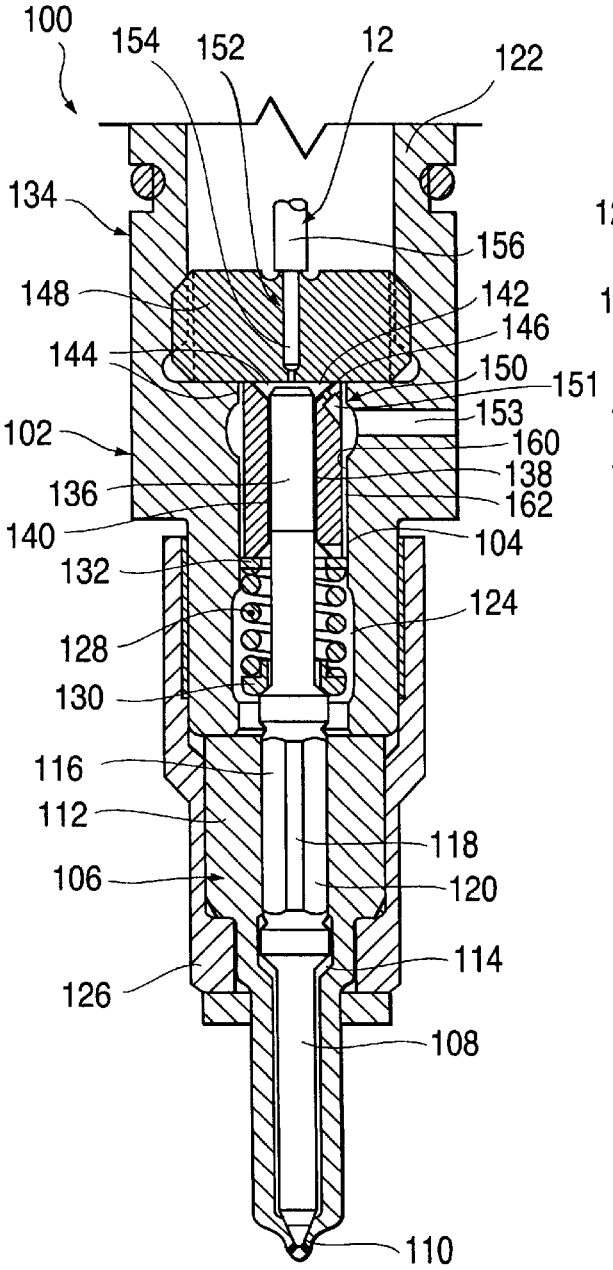
FIG. 2*a* an expanded cross sectional view of a portion of the fuel injector of the present invention showing the injection control valve member in the closed position and the nozzle valve element in the closed position.
Figure 2B:
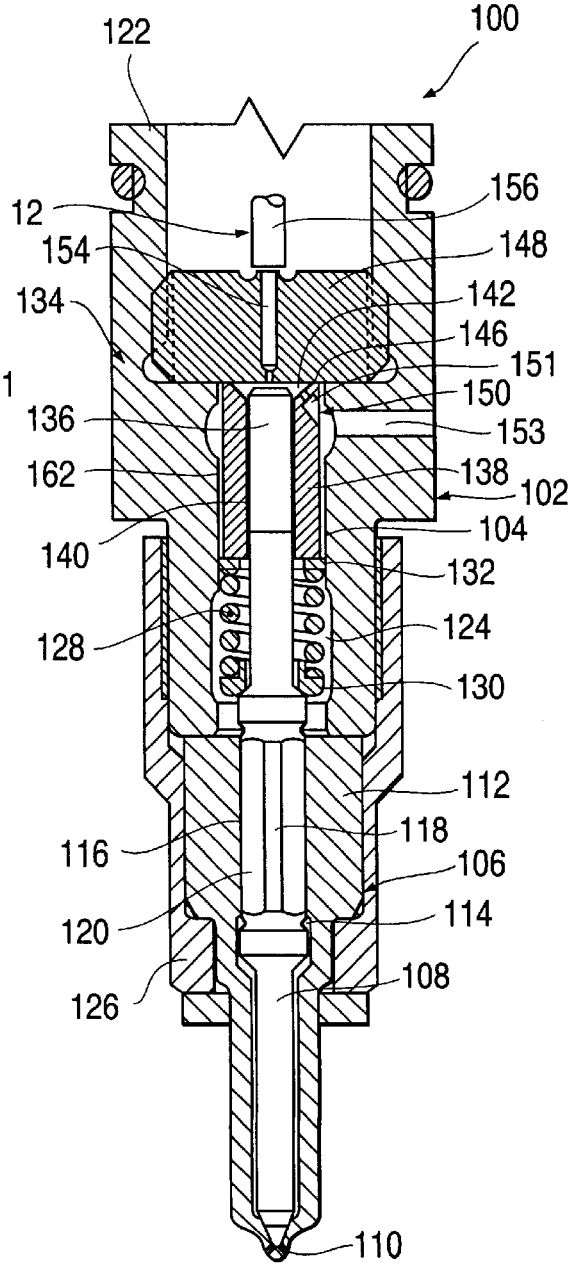
FIG. 2*b* is an expanded cross sectional view of a portion of the fuel injector of the present invention showing the injection control valve member in the open position and the nozzle valve element in the open position.

Referring to FIGS. 2*a* and 2*b*, there is shown a closed nozzle fuel injector of the present invention, indicated generally at 100, which functions to effectively permit accurate control of fuel metering while both minimizing lost energy due to pressurized fuel leakage from the injector and preventing excessive wear and stiction of the moving components of the injector as discussed hereinbelow. Fuel injector 100 is comprised of an injector body 102 having a generally elongated, cylindrical shape which forms an injector cavity 104. The lower portion of fuel injector body 102 includes a closed nozzle assembly, indicated generally at 106, which includes a nozzle valve element 108 reciprocally mounted for opening and closing injector orifices 110 formed in body 102 thereby controlling the flow of injection fuel into an engine combustion chamber (not shown).

Closed nozzle assembly 106 includes a nozzle housing 112 containing a nozzle cavity 114 for receiving pressurized fuel for injection through injector orifices 110 and a guide bore 116. Nozzle valve element 108 includes axial lands 118 positioned and sized for sliding abutment against guide bore 116 to permit guide bore 116 to slidingly support and guide the reciprocal movement of nozzle valve element 108. Lands 118 are separated by axial grooves 120 for permitting the flow of high pressure fuel inwardly into nozzle cavity 114.

Injector body 102 also includes an injector barrel 122 containing a spring cavity 124. Injector body 102 also includes a retainer 126 within which nozzle housing 112 and barrel 122 are held in compressive abutting relationship. Barrel 122 includes outer threads for engaging corresponding internal threads on retainer 126 to permit the components to be held together by simple relative rotation of retainer 126 with respect to barrel 122. A coil spring 128 is positioned in spring cavity 124 with one end in abutment with an inner spring seat 130 and an outer end in abutment against an outer spring seat 132. Inner spring seat 130 is positioned in abutment with a land formed on nozzle valve element 108 so as to permit spring 128 to bias nozzle valve element 108 into a closed position as shown in FIG. 2*a*.

Figure 1:
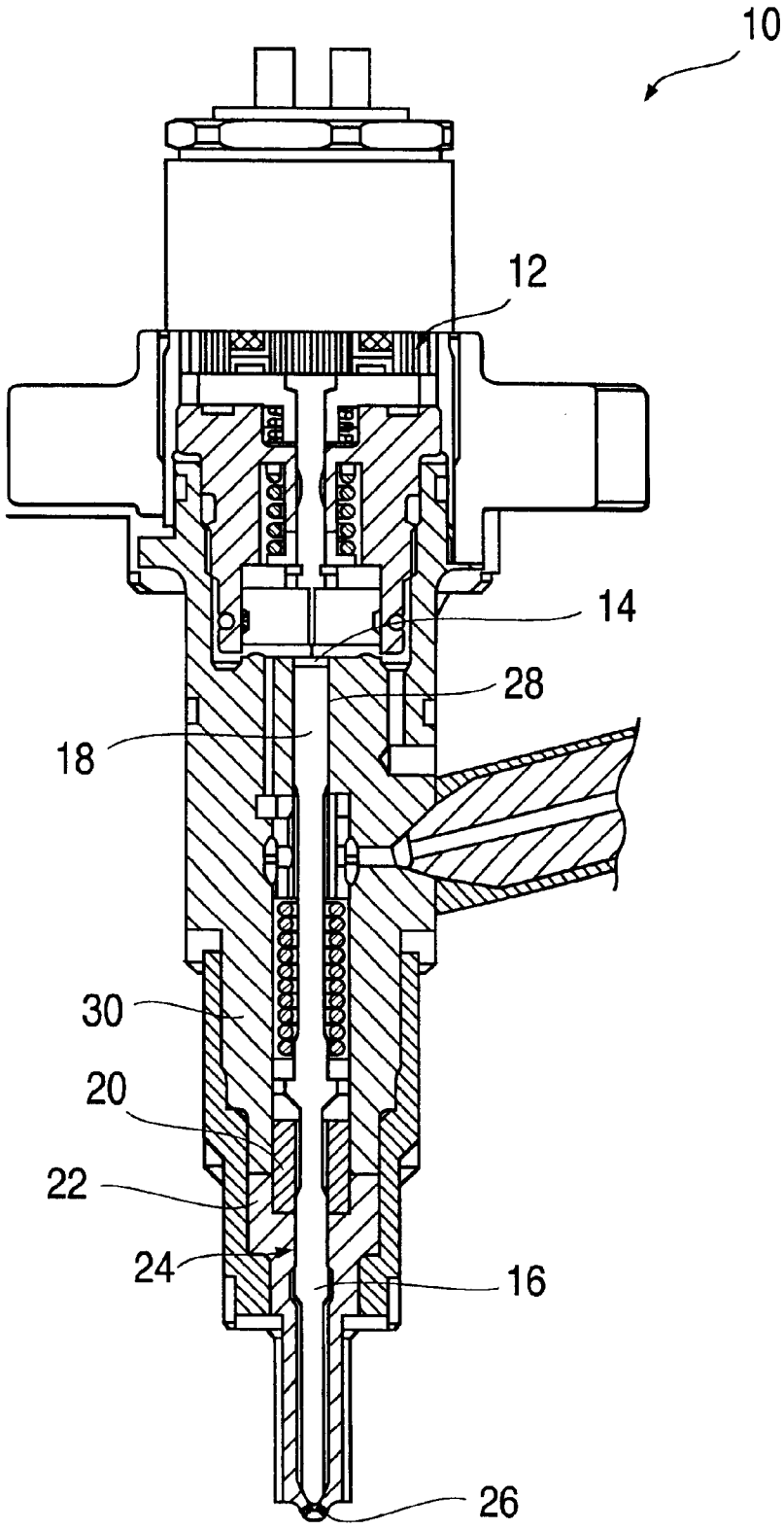
FIG. 1 (PRIOR ART)
FIG. 1 is a cross sectional view of a conventional servo-controlled fuel injector including a conventional ring dowel for alignment purposes.

Closed nozzle injector 100 further includes a nozzle valve control arrangement indicated generally at 134 for controlling the movement of nozzle valve element 108 between the closed position as shown in FIG. 2*a* and the open position as shown in FIG. 2*b* and then back into the closed position so as to define an injection event during which fuel flows through injector orifices 110 into the combustion chamber. Nozzle valve control arrangement 134 includes a control piston 136 connected to, i.e. formed integrally on, nozzle valve element 108. Nozzle valve element control arrangement 134 further includes a floating sleeve 138 containing a central bore 140 for receiving control piston 136. The outer diameter of control piston 136 and the inner diameter of bore 140 are sized relative to one another to create a close sliding fit sufficient to form a fluid seal. Nozzle valve element control arrangement 134 further includes a floating sleeve control chamber 142 formed at an outer end of floating sleeve 138 for receiving high pressure fuel. Floating sleeve 138 includes an inner end positioned in abutment against outer spring seat 132 and an outer open end 144. Floating sleeve 138 is generally cylindrical shaped and includes an outer open end sealing surface 146 extending annularly around open end 144 for continuous sealing abutment against a support 148 of injector body 102 thereby forming control chamber 142. An outer end of control piston 136 extends through bore 140 so as to be exposed to the fuel pressure of control chamber 142. Nozzle valve element control arrangement 134 further includes a charge circuit 150 including a charge passage 151 integrally formed in floating sleeve 138 so as to deliver high pressure fuel from a fuel inlet 153 to control chamber 142. The charge passage 150 includes an orifice that limits the quantity of fuel that can flow through the charge passage. Nozzle valve element control arrangement 134 also includes a drain circuit 152 and an injection control valve, indicated generally at 12, for controlling the flow of fuel from control chamber 142 through drain circuit 152 to a low pressure drain. Drain circuit 152 includes a drain passage 154 extending through support 148 and communicating at one end with control chamber 142. The drain circuit 152 may include an orifice to more accurately control the drain flow through the drain circuit. Injection control valve 12 may include any conventional actuator assembly capable of selectively controlling the movement of the injection control valve element 156. For example, injection control valve 12 may include a conventional solenoid actuator as shown in FIG. 1 or, alternatively, a piezoelectric or magnetostrictive type actuator assembly.

Importantly, floating sleeve 138 functions effectively to minimize excessive friction and wear on, and thus stiction of, control piston 136 and nozzle valve element 108 in the following manner. Floating sleeve 138 is designed with an outer surface extent or diameter sufficiently smaller than the inner extent or diameter of a cavity wall 160 within which floating sleeve 138 is positioned. As a result, the outer surface of floating sleeve 138 is positioned a spaced radial distance from cavity wall 160 so as to create a gap 162 along the entire axial length of floating sleeve 138 sufficient in size to permit floating sleeve 138 to move, expand, and contract in a radial direction due to, for example, high pressure forces in control chamber 142. Also, floating sleeve 138 avoids the expensive parts and processes necessary to effectively align the guide bore 116 with the control piston bores of conventional servo controlled nozzle valve assemblies utilizing a single piece control piston and nozzle valve element design. Specifically, both unhindered radial expansion and contraction, and lateral or transverse movement, of floating sleeve 138 is permitted since the outer surface of floating sleeve 138 does not form a close fit with cavity wall 160. In conventional injectors, the control piston bore is formed in either the outer barrel of the injector or a component rigidly fixed to the injector body thus preventing lateral movement or expansion of the control piston bore. When using an integrated nozzle valve element and control piston guided by separate guide surfaces formed in different components of the injector body rigidly connected to one another as is done in conventional injectors, the guide surfaces must be very precisely aligned to permit the integrated nozzle valve element and control piston to reciprocate smoothly and easily within the two guide bores or surfaces without excessive friction and wear in order to prevent stiction and ensure proper operation over time. As a result, many conventional injector designs require costly precision machining and additional components, for example the precision ring dowel 20 of FIG. 1, to ensure proper alignment. However, floating sleeve 138 of the present invention effectively avoids any need for alignment of the bores and permits control piston 136 and control chamber 142 to be positioned in a lateral position as determined by guide bore 116 without the need to consider the alignment of bore 140 with bore 116. That is, floating sleeve 138 will automatically allow bore 140 to effectively align with guide bore 116 to result in the floating control chamber 142.

The advantages of the floating sleeve 138 of the present invention will be better understood with a description of the operation of the fuel injector of the present invention as described hereinbelow. Referring to FIG. 2*a*, with injection control valve 12 de-actuated, injection control valve element 156 is positioned in a closed position against support 148 so as to block drain flow through drain passage 154 from control chamber 142. As a result, the fuel pressure level experienced at the fuel inlet, spring cavity 124 and nozzle cavity 114 is also present in control chamber 142. With the fuel pressure in control chamber 142 and spring cavity 124 being equal, the fuel pressure forces acting inwardly on nozzle valve element 108, in combination with the bias force of spring 128, maintain nozzle valve element 108 in its closed position blocking flow through injector orifices 110 as shown in FIG. 2*a*. Importantly, since bias spring 128 provides the only force holding the open end sealing surface 146 of floating sleeve 138 in sealing abutment against support 148, floating sleeve 138 is permitted to move in a transverse or radial direction thereby permitting transverse or radial movement of control chamber 142 and thus minimizing nozzle valve bending, friction and wear.

At a predetermined time during engine operation, injection control valve 12 is actuated to controllably move control valve member 156 from the closed position shown in FIG. 2*a* to an open position shown in FIG. 2*b* thereby allowing the flow of fuel from control chamber 142 through drain passage 154 to a low pressure drain. Simultaneously, high pressure fuel flows from charge circuit 150 into control chamber 142 via the charge passage orifice which immediately results in a pressure drop across the charge passage orifice. As a result, the pressure in control chamber 142 immediately decreases below the pressure in charge circuit 150, spring cavity 124 and nozzle valve cavity 114. The relative size of the charge passage orifice, the drain passage orifice, and the restriction through the control valve can be selected to optimize the flow out drain passage 154 which in turn will increase or decrease the control chamber pressure and rate of change of the control chamber pressure as desired. Fuel pressure forces acting on nozzle valve element 108 due to the high pressure fuel in nozzle cavity 114 and spring cavity 124, begin to move nozzle valve element 108 outwardly against the bias force of spring 128 into the open position as shown in FIG. 2*b*. Importantly, the reduced control chamber pressure also results in a large fuel pressure force holding the floating sleeve 138 in abutment against support 148. Consequently, this substantial fuel pressure induced bias force enhances the sealing contact between open end sealing surface 146 of floating sleeve 138 and support 148 to minimize fuel leakage at this sleeve and support interface. The diameter of floating sleeve 138 expands and contracts with the change in control chamber pressure as the fuel injector is actuated and de-actuated. This expansion and contraction of floating sleeve 138 results in a dynamic coefficient of friction at the interface of open end sealing surface 146 and support 148 which is lower than a static coefficient of friction. As a result, importantly, this dynamic coefficient of friction resulting from the design of the floating sleeve 138 of the present invention, assists in minimizing control piston and nozzle valve element bending and wear since floating sleeve 138 can more freely move to compensate for misalignments between the guiding surfaces/bores. The open end sealing surface 146 can be designed with an appropriate cross sectional surface area by selecting the inner and outer diameters of floating sleeve 138 appropriately so as to result in the optimal force and contact area. Upon de-actuation of injection control valve 12, control valve element 156 moves back into the closed position causing repressurization of control chamber 142 and movement of nozzle valve element 108 into the closed position as shown in FIG. 2*a*.

Figure 3:
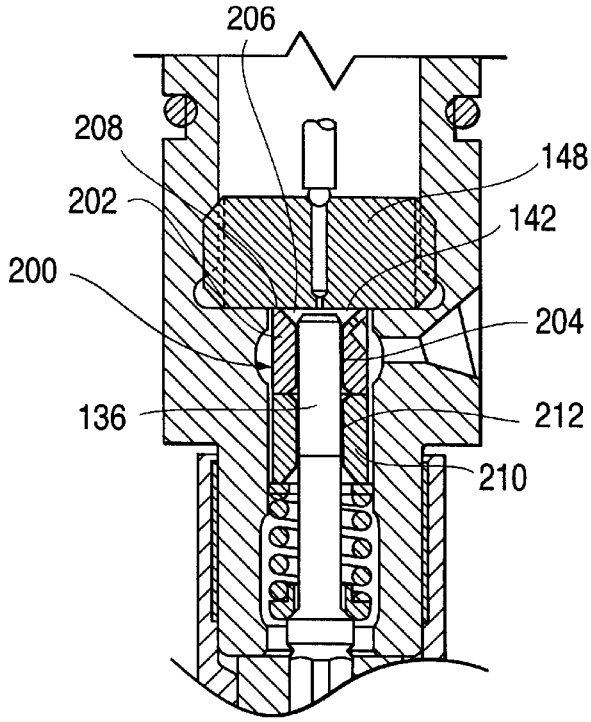
FIG. 3 is an expanded cross sectional view of a second embodiment of the fuel injector of the present invention including a two piece floating sleeve.

FIG. 3 illustrates a second embodiment of the present invention which is similar to the previous embodiment except that a multi piece floating sleeve 200 is used instead of a single piece floating sleeve. Multi piece floating sleeve 200 includes a first sleeve 202 including a bore 204, an open end 206 and an annular open end sealing surface 208. Floating sleeve 200 also includes a second sleeve 210 positioned in abutment against a lower end of first sleeve 202. Second sleeve 210 also includes a bore 212 for receiving control piston 136 which extends through bore 212 and bore 204. Although the previous embodiment effectively creates a floating sleeve and floating control chamber which precludes the need to align the guiding surfaces of the nozzle valve element, perpendicularity errors may occur between the control piston and nozzle valve element axis and the open end seating surface 208 or the opposing seating surface formed on the support. With the floating sleeve 138 of the previous embodiment mounted on control piston 136, open end sealing surface 146 should be mounted in flush annular sealing abutment against the support 148 when support 148 and open end sealing surface 208 are perpendicular to the axis of the control piston and nozzle valve element. However, in some situations, the axis of control piston 136 may be positioned relative to the surface of support 148, i.e. nonperpendicular, such that open end sealing surface 146 does not sufficiently seat against support 148. The present embodiment compensates for differences in tolerances and perpendicularity errors between the control piston and nozzle valve element axis and both the seating surface of the support and the open end sealing surface 208. The shorter lengths of each sleeve 202 and 210 relative to a single piece floating sleeve of the same combined length permits first sleeve 202 to compensate for these perpendicularity errors by shifting slightly to create a firm abutment against the support and thus possibly a more effective seal to form control chamber 142.

Figure 4:
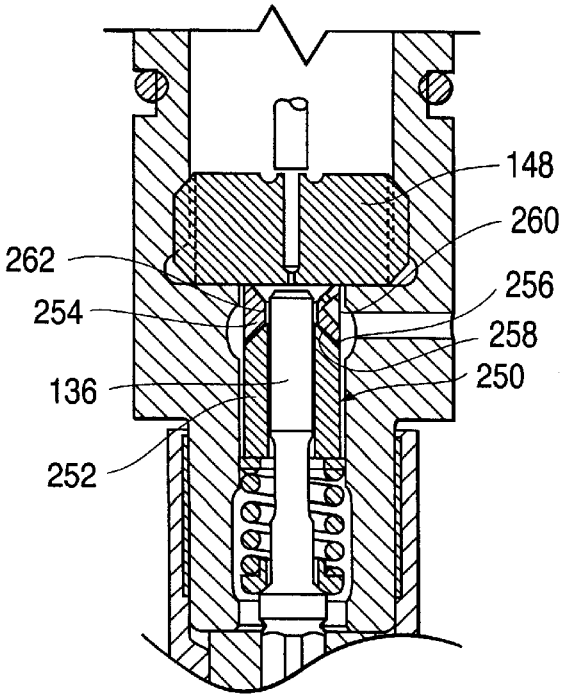
FIG. 4 is an expanded cross sectional view of a third embodiment of the fuel injector of the present invention including a sleeve seat section forming a swivel joint.

FIG. 4 illustrates yet a third embodiment of the floating sleeve of the present invention, indicated generally at 250 which includes a main sleeve portion 252 and a separate sleeve seat portion 254 positioned in abutment with main sleeve section 252 to form an upper swivel joint 256. Sleeve seat section 254 is similar to the upper portion of the first embodiment shown in FIGS. 2*a* and 2*b* except that sleeve seat section 254 is very short in length and includes a lower conical or semi-spherical surface 258. Main sleeve section 252 includes an upper annular semi-spherical surface 260 having a complementary shape to surface 258 so as to create a sufficiently close sealed bit while permitting swiveling movement between sleeve seat section 254 and main sleeve section 252. Importantly, sleeve seat section 254 also includes an inner bore 262 having a diameter sufficiently greater than the diameter of control piston 136 so as to permit lateral shifting or swiveling of sleeve seat section 254. As a result, the present swivel joint embodiment of floating sleeve 250 effectively compensates for perpendicularity error between the control piston/nozzle valve and the sealing surface formed on the support thereby permitting transverse movement and expansion of floating sleeve 250 and thus control chamber 142 while ensuring effective sealing at the interface of sleeve 250 and the support.

Figure 5:
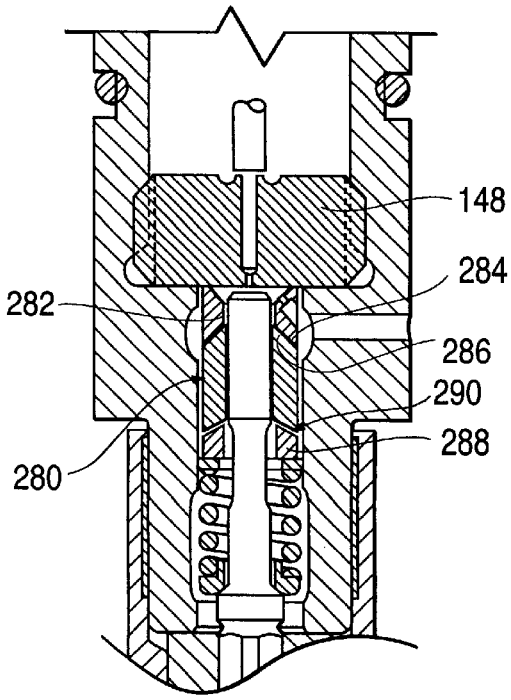
FIG. 5 is an expanded cross sectional view of a third embodiment of the fuel injector of the present invention including two seat sections forming multiple swivel joints.

FIG. 5 discloses a fourth embodiment including a floating sleeve 280 which is very similar to the floating sleeve of the previous embodiment in that it includes a sleeve seat section 282 forming a swivel joint 284 with a main sleeve section 286. However, the present embodiment also includes a spring sleeve section 288 formed separately from main sleeve section 286 but positioned in abutment with main sleeve section 286 to form a lower swivel joint 290 similar to upper joint 282. Lower swivel joint 290 is formed by an upper annular semi-spherical surface formed on spring sleeve section 288 which abuts in a complementary manner a lower conical or annular semi-spherical surface formed on main sleeve section 286. Both sleeve seat section 282 and spring sleeve section 288 each include a bore for receiving the control piston/nozzle valve which are sized with a diameter sufficiently greater than the diameter of control piston so as to permit swiveling of the respective sections. This embodiment not only accommodates perpendicularity error between the control piston/nozzle valve and the sealing surface of the support, but also reduces side loading on floating sleeve 280 due to nonaxial forces created by the bias forces of spring 128. That is, if the lower end of the floating sleeve does not interface outer spring seat 132 in a flush manner and likewise the upper end of spring 128 does not seat against outer spring seat 132 in a flush manner, slight nonaxial forces will be imparted on the floating sleeve. Floating sleeve 280 of the present embodiment effectively compensates for these misalignments and nonaxial forces.

Figure 6:
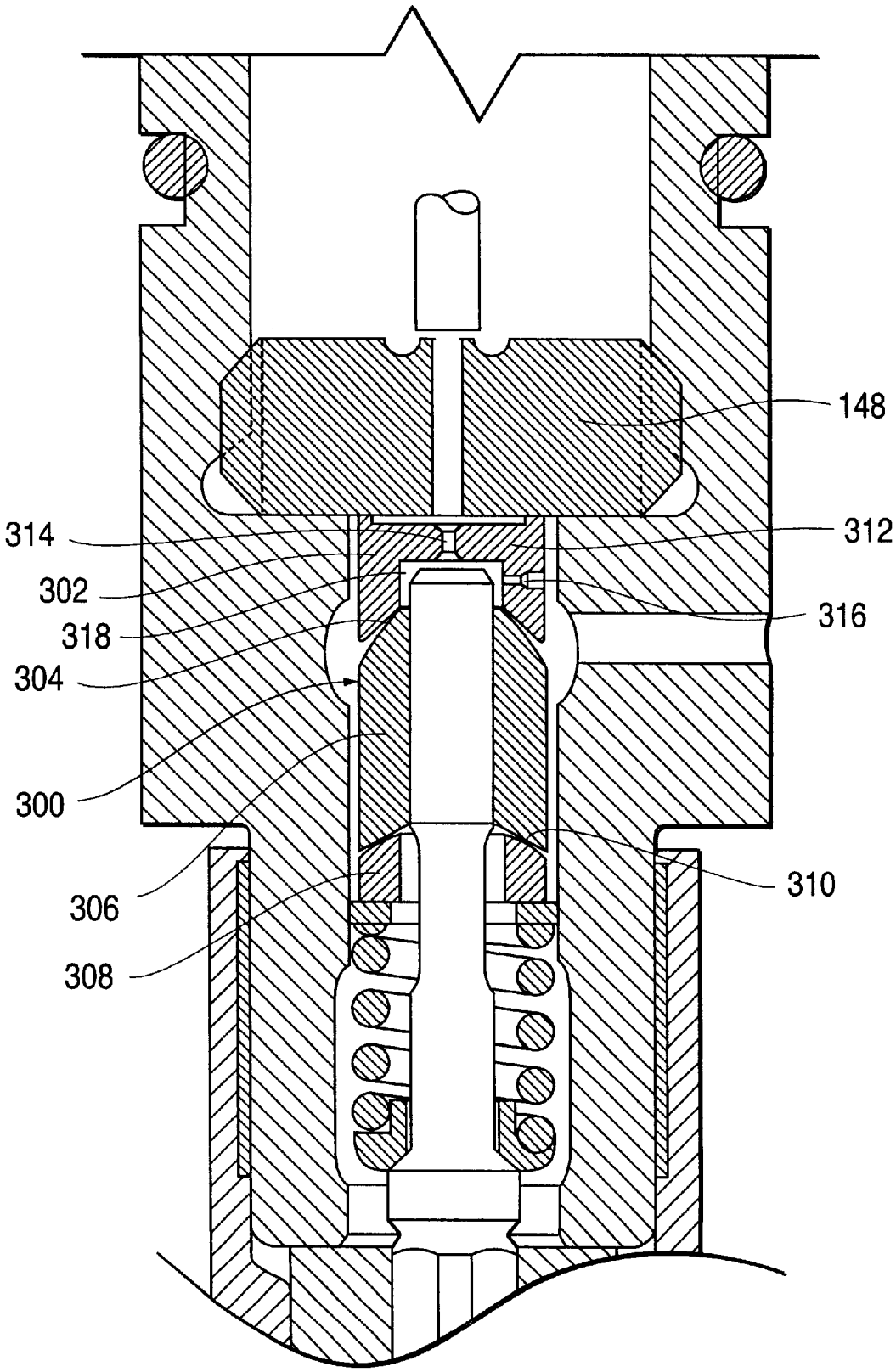
FIG. 6 is an expanded cross sectional view of a fourth embodiment of the fuel injector of the present invention including a sleeve seat section having a closed upper end forming a portion of the control chamber and including both the drain passage orifice and charge passage.

FIG. 6 discloses a fifth embodiment including a floating sleeve 300 which is very similar to the floating sleeve of the previous embodiment in that it includes a sleeve seat section 302 forming an upper swivel joint 304 with a main sleeve section 306. Floating sleeve 300 further includes a spring seat section 308 forming a lower swivel joint 310 with main sleeve section 306. However, sleeve seat section 302 of the present embodiment includes a closed upper end 312 which includes both a drain passage orifice 314 and a charge passage 316. Accordingly, sleeve seat section 302 also forms a portion of the control chamber 318. Like the previous embodiments, sleeve seat section 302 is maintained in sealing abutment against support 148.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection control in order to minimize emissions. Such internal combustion engines including a fuel injector in accordance with the present invention can be widely used in all industrial fields, commercial and noncommercial applications, including trucks, passenger cars, industrial equipment, stationary power plants and others.

We claim:

1. A closed nozzle injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control piston positioned on said nozzle valve element;

a floating sleeve mounted on said control piston for lateral movement relative to said injector body and at least partially defining a control chamber, said sleeve including a bore for receiving said control piston, an open distal end and an open distal end sealing surface positioned in continuous sealing abutment against said injector body to prevent fuel flow from said control chamber;

a drain circuit for draining fuel from said control chamber to a low pressure drain; and an injection control valve positioned along said drain circuit to control fuel flow from said control volume.

2. The injector of claim 1, further including a charge circuit for supplying pressurized fuel to said control chamber, said charge circuit including a charge passage formed in said floating sleeve.

3. The injector of claim 1, wherein said floating sleeve includes an outer surface positioned a spaced radial distance from said injector body to permit the lateral movement of said floating sleeve relative to said injector body.

4. The injector of claim 1, wherein said injection control valve is movable between an open position causing depressurization of said control chamber and a closed position causing pressurization of said control chamber, the injector further including a biasing means for biasing said open distal end sealing surface into sealing abutment against said injector body with a first biasing force when said injection control valve is in said closed position and a second biasing force when said injection control valve is in said open position, said second biasing force being greater than said first biasing force.

5. The injector of claim 1, wherein said biasing means includes a spring for applying said first biasing force and fuel pressure forces for applying said second biasing force to said floating sleeve.

6. The injector of claim 1, wherein said floating sleeve includes a sleeve seat section and a main sleeve section positioned in sealing abutment against said first sleeve section to form an upper swivel joint.

7. The injector of claim 6, wherein said floating sleeve further includes a spring seat sleeve section positioned in abutment against said main sleeve section to form a lower swivel joint, said main sleeve section positioned axially between said sleeve seat section and said spring seat sleeve section.

8. The injector of claim 1, wherein said floating sleeve includes a first sleeve and a second sleeve positioned in sealing abutment against said first sleeve, each of said first and said second sleeves including said bore, said control piston having a sufficiently close sliding fit with an inside surface of said bore to form a fluid seal.

9. The injector of claim 6, further including a charge circuit for supplying pressurized fuel to said control chamber, said charge circuit including a charge passage formed in said sleeve seat section.

10. The injector of claim 1, wherein said control piston is formed integrally on said nozzle valve element.

11. A closed nozzle injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control piston positioned on said nozzle valve element;

a floating sleeve means mounted on one end of said control piston for lateral movement relative to said injector body and at least partially defining a control chamber, said floating sleeve means including a bore for receiving said control piston, an outer surface positioned a spaced radial distance from said injector body to permit the lateral movement, and an end sealing surface positioned in sealing abutment against said injector body to prevent fuel flow from said control chamber;

a drain circuit for draining fuel from said control chamber to a low pressure drain;

an injection control valve positioned along said drain circuit to control fuel flow from said control chamber, said injection control valve movable between an open position causing depressurization of said control chamber and a closed position causing pressurization of said control chamber; and a biasing means for biasing said floating sleeve means into sealing abutment against said injector body with a first biasing force when said injection control valve is in said closed position and a second biasing force when said injection control valve is in said open position, said second biasing force being greater than said first biasing force.

12. The injector of claim 11, further including a charge circuit for supplying pressurized fuel to said control chamber, said charge circuit including a charge passage formed in said floating sleeve means.

13. The injector of claim 11, wherein said biasing means includes a spring for applying said first biasing force and fuel pressure forces for applying said second biasing force to said floating sleeve means.

14. The injector of claim 11, wherein said floating sleeve means includes a sleeve seat section and a main sleeve section positioned in sealing abutment against said first sleeve section to form an upper swivel joint.

15. The injector of claim 14, wherein said floating sleeve means further includes a spring seat sleeve section positioned in abutment against said main sleeve section to form a lower swivel joint, said main sleeve section positioned axially between said sleeve seat section and said spring seat sleeve section.

16. The injector of claim 11, wherein said floating sleeve means includes a first sleeve and a second sleeve positioned in sealing abutment against said first sleeve, each of said first and said second sleeves including said bore, said control piston having a sufficiently close sliding fit with an inside surface of said bore to form a fluid seal.

17. The injector of claim 14, further including a charge circuit for supplying pressurized fuel to said control chamber, said charge circuit including a charge passage formed in said sleeve seat section.

18. The injector of claim 11, wherein said floating sleeve means includes a closed upper end forming said control chamber.

19. The injector of claim 11, further including a charge circuit for supplying pressurized fuel to said control chamber, each of said drain circuit and said charge circuit being formed in said floating sleeve means.

20. The injector of claim 14, wherein said sleeve seat section includes a closed upper end forming said control chamber.

21. The injector of claim 20, wherein said sleeve seat section includes both said drain circuit and a charge circuit for supplying pressurized fuel to said control chamber.

* * * * *